US006759631B1

(12) United States Patent
Geissinger et al.

(10) Patent No.: US 6,759,631 B1
(45) Date of Patent: Jul. 6, 2004

(54) CERAMIC SHEATHED-ELEMENT GLOW PLUG WITH ELECTRICALLY CONDUCTIVE POWDER PELLET CONTACTING ELEMENT AND METHOD FOR MAKING

(75) Inventors: Albrecht Geissinger, Muehlacker (DE); Christoph Kern, Aspach (DE); Steffen Schott, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 238 days.

(21) Appl. No.: 09/830,640

(22) PCT Filed: Jul. 25, 2000

(86) PCT No.: PCT/DE00/02420

§ 371 (c)(1),
(2), (4) Date: Aug. 2, 2001

(87) PCT Pub. No.: WO01/16529

PCT Pub. Date: Mar. 8, 2001

(30) Foreign Application Priority Data

Aug. 27, 1999 (DE) ..... 199 40 668
Apr. 26, 2000 (DE) ..... 100 20 328

(51) Int. Cl.[7] ..... H05B 3/00
(52) U.S. Cl. ..... 219/270; 123/145 A; 29/613
(58) Field of Search ..... 219/270, 544, 219/541; 123/145 A, 145 R; 29/613

(56) References Cited

U.S. PATENT DOCUMENTS 4,281,451 A * 8/1981 Mann ..... 29/611
4,437,440 A * 3/1984 Suzuki et al. ..... 123/145 A
5,020,489 A 6/1991 Koji et al.
5,589,091 A 12/1996 Mueller
6,013,898 A * 1/2000 Mizuno et al. ..... 219/270
6,459,072 B1 * 10/2002 Selmi et al. ..... 219/270

FOREIGN PATENT DOCUMENTS

GB 2282640 * 4/1995
JP 54-153935 * 5/1979
JP 61-107013 * 5/1986
JP 9-112904 * 5/1997

* cited by examiner

*Primary Examiner*—John A. Jeffery
(74) *Attorney, Agent, or Firm*—Kenyon & Kenyon

(57) ABSTRACT

A ceramic sheathed-element glow plug includes a ceramic glow element made of an electrically conductive layer and an electrically insulating layer, in which the conductive layer is made of supply layers and a heating layer. The higher specific electrical resistance of the heating layer allows the temperature of the heating layer and of the combustion chamber to be determined, and the electrical contact between a connecting element and the glow element is established by a contacting element that is composed of a pellet made of an electrically conductive powder.

10 Claims, 4 Drawing Sheets

CERAMIC SHEATHED-ELEMENT GLOW PLUG WITH ELECTRICALLY CONDUCTIVE POWDER PELLET CONTACTING ELEMENT AND METHOD FOR MAKING

FIELD OF THE INVENTION

The present invention relates to a ceramic sheathed-element glow plug for diesel engines.

BACKGROUND INFORMATION

Glow plugs having external ceramic heaters are discussed, for example, in German Published Patent Application No. 40 28 859. Furthermore, German Published Patent Application No. 29 37 884 discusses metallic sheathed-element glow plugs in which the metallic glow filament is welded to a thermoelement. During the operation of the sheathed-element glow plug, the temperature of the respective cylinder can be measured here by measuring the heat-generated voltage. However, it is believed that no metallic glow filament is present in a sheathed-element glow plug having a ceramic heating element.

Furthermore, German Published Patent Application No. 198 44 347 discusses a sheathed-element glow plug having a connecting element which is electrically connected to the glow element via a contacting element. The contacting element is shown as a spring in FIG. 1.

SUMMARY OF THE INVENTION

The exemplary ceramic sheathed-element glow plug according to the present invention is believed that the advantage that the temperature of the glow element is measurable. In a sheathed-element glow plug, the temperature of the glow element can be measured directly in a selected area on the outside of the glow element without additional hardware. The temperature is measured in a selected volume that is small in comparison with the volume of the entire glow element, so that the error occurring due to temperature distribution over a large volume can be reduced in determining the temperature. Also, in the exemplary sheathed-element glow plug according to the present invention, the heating power can be concentrated to a selected area of the glow element without modifying the cross-section of the conductive layer, so that the surface area remains constant in the area in which the heating power is to be concentrated and thus also the interaction area is kept constant. It is also believed that such a ceramic sheathed-element glow plug can be manufactured in a cost-effective manner.

In particular, by selecting the appropriate ceramic materials used for the different areas of the sheathed-element glow plug, it is believed that it is ensured that the mechanical stability of the heater is not impaired. By having the measured temperature values processed by a controller, the temperature can be regulated in the selected area of the glow element. Also, the exemplary sheathed-element glow plug according to the present invention may be used in a passive mode as a temperature sensor after it has performed its heating function. Thus it can be determined whether the combustion process is taking place correctly in the respective cylinder. It is believed that the parameters relevant to the combustion can be influenced on the basis of this information.

The exemplary ceramic sheathed-element glow plug according to the present invention is believed to have the advantage that, due to the greater conductive cross-section, higher currents can be transmitted without causing heat damage to the material of the contacting element. The large surface area of the contacting material is also believed to be advantageous because it provides good heat conductivity. It is believed that the elastic spring component ensures that thermal displacements of surrounding components due to different thermal expansion coefficients can be compensated.

The contacting element may be made of graphite or a conductive ceramic powder, since these materials are corrosion-resistant. Also, only a predominant portion of the material may be made of graphite or conductive ceramic or metal powder, thus saving on expensive materials while achieving approximately the same characteristics. If the sheathed-element glow plug having a contacting element according to the exemplary embodiment of the present invention is manufactured as described below, it is believed that this provides an arrangement of the components located in the glow element housing that prevents short-circuits. In addition, it is believed to be ensured that the components are pressed together so that they do not come loose or burst due to the excessive reactive force of elastic elements (e.g., of the contacting element).

DETAILED DESCRIPTION

Figure 1:
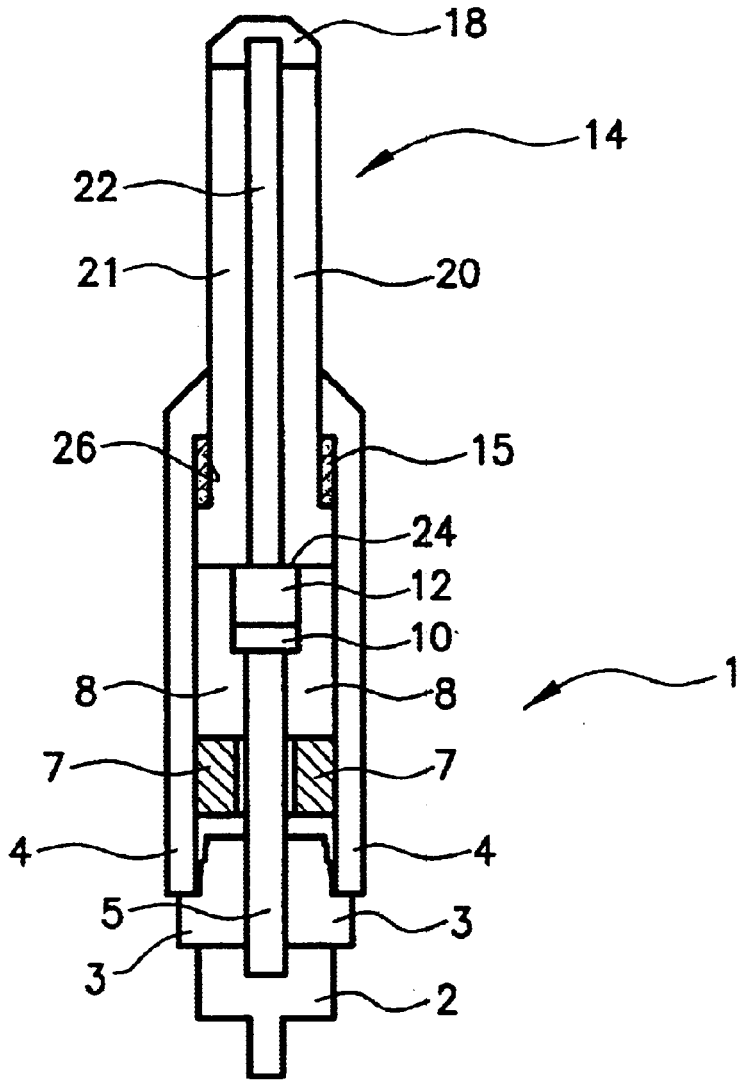
FIG. 1 shows a longitudinal section through the exemplary sheathed-element glow plug according to the present invention.

FIG. 1 schematically shows a longitudinal section through an exemplary ceramic sheathed-element glow plug 1 according to the present invention. At its end farther removed from the combustion chamber, sheathed-element glow plug 1 is electrically contacted through a round plug 2, which is isolated from glow element housing 4 by a gasket 3 and is connected to cylindrical supply conductor 5. Cylindrical supply conductor 5 is secured in glow element housing 4 via a metal ring 7 and an electrically insulating ceramic sleeve 8. Cylindrical supply conductor 5 (via a contact pin 10) and a suitable contacting element 12, which may be a contact spring or an electrically conductive powder packing or an electrically conductive pellet with an elastic spring component that may be made of graphite, are connected to ceramic glow element 14. Cylindrical supply conductor 5 may also be combined with contact pin 10 in a single component. The inside of the sheathed-element glow plug is sealed against the combustion chamber by a sealing gasket 15. Sealing gasket 15 is made of an electrically conductive carbon compound. Sealing gasket 15 may, however, also be made of metal, a mixture of carbon and metal, or a mixture of ceramic and metal. Glow element 14 is made of a ceramic heating layer 18 and ceramic supply layers 20 and 21, the two supply layers 20, 21 being connected by heating layer 18 and, together via heating layer 18, forming the conductive layer. Supply layers 20, 21 and heating layer 18 may have any desired shape. The conductive layer may have a U shape. Supply layers 20, 21 are isolated via an insulation layer 22, which is also made of a ceramic material. In the exemplary embodiment of FIG. 1, glow element 14 is designed so that supply layers 20, 21 and heating layer 18 are arranged outside on glow element 14. At least supply layers 20, 21 may also be arranged so that they are located inside the glow element and are additionally covered by an external ceramic insulating layer. Within the glow element housing, the ceramic glow element is insulated from the other components 4, 8, 12, 15 of the glow element by a glass layer (not illustrated). In order to establish the electrical contact between contacting element 12 and supply layer 20, the glass layer is interrupted at point 24. The glass layer is also interrupted for an electrical contact between supply layer 21 and glow element housing 4 via sealing gasket 15 at point 26. In the exemplary embodiment, heating layer 18 is located at the tip of the glow element as a preferred embodiment. This heating layer may also be placed at some other location of the conductive layer. Heating layer 18 should be located at the point where the greatest heating effect is to be achieved.

Figure 2:
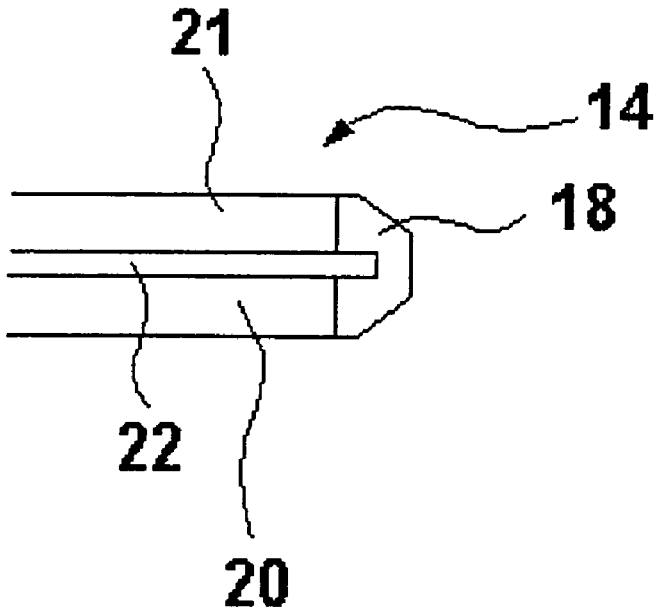
FIG. 2 shows a side view of the front section of the external ceramic heater.

FIG. 2 shows a side view of the same ceramic heating element. As in FIG. 1, the exemplary embodiment in which heating layer 18 is located at the tip of the glow element is illustrated. Furthermore, supply layers 20, 21 and insulation layer 22 can be seen. In this side view, the exemplary embodiment in which the conducting layer composed of supply layers 20 and 21 and heating layer 18 has a U-shaped design is shown.

The operating mode in which the glow element is heated to support combustion in the combustion chamber is known as the active mode. This heating takes place when the internal combustion engine is started, during a post-glow phase which should extend over 3 minutes, as well as during an intermediate glow phase when the temperature of the combustion chamber drops excessively during the operation of the internal combustion engine.

The material of the ceramic sheathed-element glow plug according to an exemplary embodiment of the present invention is selected so that the absolute electrical resistance of heating layer 18 is greater than the absolute electrical resistance of supply layers 20, 21. (In the following, the term resistance will be understood to denote absolute electrical resistance). In order to avoid cross-currents between the insulation layer, the resistance of the insulation layer is selected so that it is considerably greater than the resistance of heating layer 18 and supply layers 20, 21.

Figure 3:
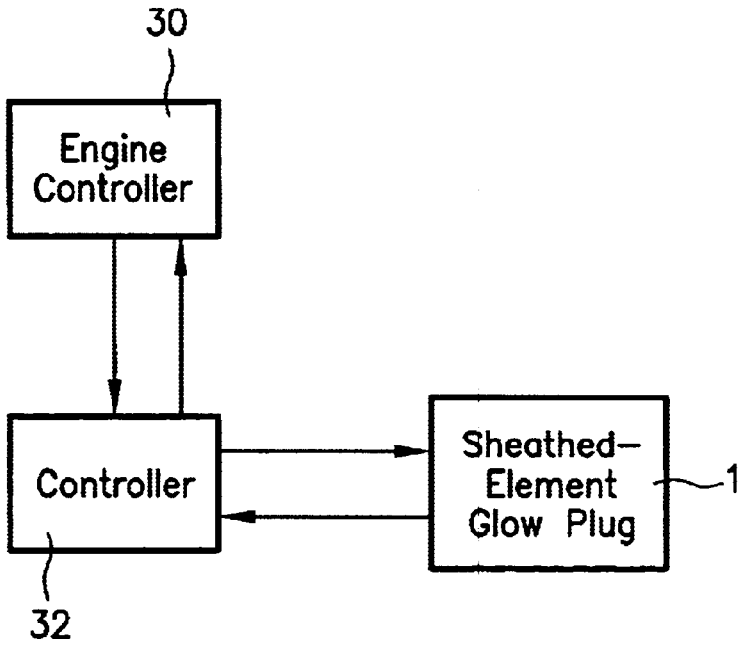
FIG. 3 shows the interconnection between the exemplary sheathed-element glow plug according to the present invention with the controllers.

FIG. 3 schematically shows the devices that communicate with sheathed-element glow plug 1. These include engine controller 30, which contains a computing unit and a memory unit. The engine-dependent parameters of the sheathed-element glow plug are stored in engine controller 30. These may include, for example, the resistance-temperature characteristic maps as a function of the engine load and engine rpm. The memory of the engine controller also contains one or more temperature reference values for correct combustion. The engine controller may control parameters that influence combustion, for example, time of injection, start of fuel injection, and end of fuel injection. Controller 32 regulates a voltage defined by the engine controller. This voltage represents the total voltage used for the sheathed-element glow plug. Controller 32 also houses an ammeter used for measuring the current flowing through the glow element. In addition, controller 32 contains a memory and a computing unit. Engine controller 30 and controller 32 may also be combined in a single device.

Figure 4:
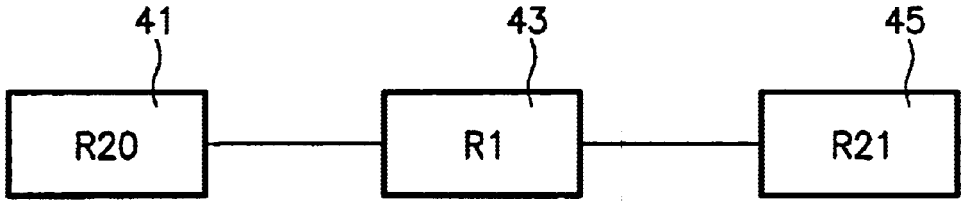
FIG. 4 shows the exemplary sheathed-element glow plug according to the present invention and the resistances in the supply conductors.

FIG. 4 shows the resistances across the sheathed-element glow plug. Resistance 41 having a value R20 is the resistance of ceramic supply layer 20. Resistance 43 having value R1 includes the resistance of the heating layer. Resistance 45 having a value R21 includes the resistance of ceramic supply layer 21. Additional resistances include those of the other supply and return leads, which, however, are believed to be small compared with resistances R20 and R21 and are therefore not taken into account. They are not shown in FIG. 4. Resistances 41, 43, and 45 are connected in series. For the discussions with reference to FIG. 4, any cross-currents that may appear are ignored. Thus, the total resistance R is composed of the sum of resistances R20, R1, and R21. Resistance R1 is the greatest summand.

An effective voltage, which is regulated by controller 32, is defined by engine controller 30 using the characteristic maps contained therein and the desired temperature of the glow element. Due to the temperature-dependence of resistances 41, 43, and 45, a current I flows through the sheathed-element glow plug, i.e., through resistance R, which is measured in controller 32. The temperature-dependence of the total resistance R=R20+R1+R21 is believed to be determined mainly by the temperature-dependence of resistance R1, since this resistance has the highest value. The temperature-dependence of resistances R20, 21, and R21 is almost constant over the entire operating range of the sheathed-element glow plugs between room temperature and a temperature of approximately 1400° C. The temperature of the combustion chamber is in the operating range of the sheathed-element glow plugs.

Using a stored characteristic map, measured current intensity I is converted by controller 32 into a temperature which results mainly from the temperature of heating layer 18 due to the considerably higher value of resistance R1 compared to resistances R20 and R21. This temperature is returned to engine controller 30, the effective voltage for the sheathed-element glow plug being redefined on the basis of the temperature determined.

It is also possible to output the temperature of heating layer 18 of the glow element in another manner, for example, on a display. It is furthermore possible to draw conclusions concerning the quality of combustion in each cylinder from the temperature determined, for example, taking into account one or more reference temperatures stored in engine controller 30. In the case of incorrect combustion, cylinder-specific measures influencing the combustion can be taken by the controller to restore correct combustion. For example, the time of injection, the start of fuel injection, or the injection pressure can be varied.

In another exemplary embodiment, the temperature of the combustion chamber can also be measured in the passive mode of the sheathed-element glow plug, i.e., after the post-glow phase, when the sheathed-element glow plug is no longer in active operation. In this case, a lower effective voltage is defined and, as in active operation, current I flowing through resistance R is measured and thus the temperature of the heating area is estimated, which then corresponds to the temperature of the combustion chamber. As in the active mode, the combustion chamber temperature can be compared to one or more reference values for correct combustion stored in the engine controller for each cylinder. If the combustion chamber temperature no longer corresponds to correct combustion, measures can be taken to ensure correct combustion, as described for the active mode of the sheathed-element glow plug; for example, the injection time, the start of fuel injection and the injection pressure may be varied.

The value of resistances R20, R1, and R21 and their dependence on the temperature are set through the temperature-dependence of specific resistance p on the basis of the equation $$R=\rho*1/A$$

where 1 is the length of the resistor and A is the cross-sectional area. The temperature-dependence is obtained from $$\rho(T)=\rho_0(T_0)*(1+\alpha(T)*(T-T_0))$$

where $\rho(T)$ is the specific resistance as a function of temperature T; $\rho_0$ is the specific resistance at room temperature $T_0$, and $\alpha(T)$ is a temperature coefficient, which is temperature-dependent.

In order to achieve a different temperature-dependence of the resistances of supply conductors R20 and R21 as compared to resistance R1, the specific resistance of heating layer 18 can be selected so that $\rho_0$ of the heating layer is greater than $\rho_0$ of the supply layers. As an alternative, temperature coefficient $\alpha$ of heating layer 18 can be greater in the operating range of the sheathed-element glow plug than temperature coefficient $\alpha$ of supply layers 20, 21. It is also possible to select both $\rho_0$ and $\alpha$ to be greater for heating layer 18 than for supply layers 20, 21 in the operating range of the sheathed-element glow plug.

In an exemplary embodiment, the composition of heating layer 18 and of supply layers 20, 21 is selected so that $\rho_0$ of supply layers 20, 21 is at least 10 times smaller than the $\rho_0$ of heating layer 18. Temperature coefficient $\alpha$ of heating layer 18 and of supply layers 20, 21 is approximately the same. Thus an accuracy of 20 K is achieved in the temperature measurement over the entire operating range of the sheathed-element glow plug.

In an exemplary embodiment, the specific resistance of insulation layer 22 is at least 10 times greater than the specific resistance of heating layer 18 in the entire operating range of the sheathed-element glow plug.

In an exemplary embodiment, the heating layer, the supply layers, and the insulation layer are made of ceramic composite structures containing at least two of the compounds $Al_2O_3$, $MoSi_2$, $Si_3N_4$, and $Y_2O_3$. These composite structures can be obtained by a single-stage or multistage sintering process. The specific resistance of the layers can be determined by the $MoSi_2$ content and/or the particle size of $MoSi_2$; the $MoSi_2$ content of supply layers 20, 21 may be higher than the $MoSi_2$ content of heating layer 18, with heating layer 18 in turn having a higher $MoSi_2$ content than insulation layer 22.

In another exemplary embodiment, heating layer 18, supply layers 20, 21, and insulation layer 22 are made of a composite precursor ceramic having different filler contents. The matrix of this material is made of polysiloxanes, polysilsequioxanes, polysilanes, or polysilazanes, which may be doped with boron or aluminum and can be manufactured by pyrolysis. The filler for the individual layers is formed by at least one of the compounds $Al_2O_3$, $MoSi_2$, and SiC. As in the case of the above-mentioned composite structure, the $MoSi_2$ content and/or the particle size of $MoSi_2$ can determine the specific resistance of the layers. The $MoSi_2$ content of supply layers 20, 21 may be set higher than that of heating layer 18, with heating layer 18 in turn having a higher $MoSi_2$ content than insulation layer 12.

The compositions of the insulation layer, the supply layers and the heating layer are selected in the exemplary embodiments described above so that their thermal expansion coefficients and the shrinkages of the individual supply, heating, and insulation layers occurring during the sintering and pyrolysis operations are the same, so that no cracks are formed in the glow element.

Figure 5:
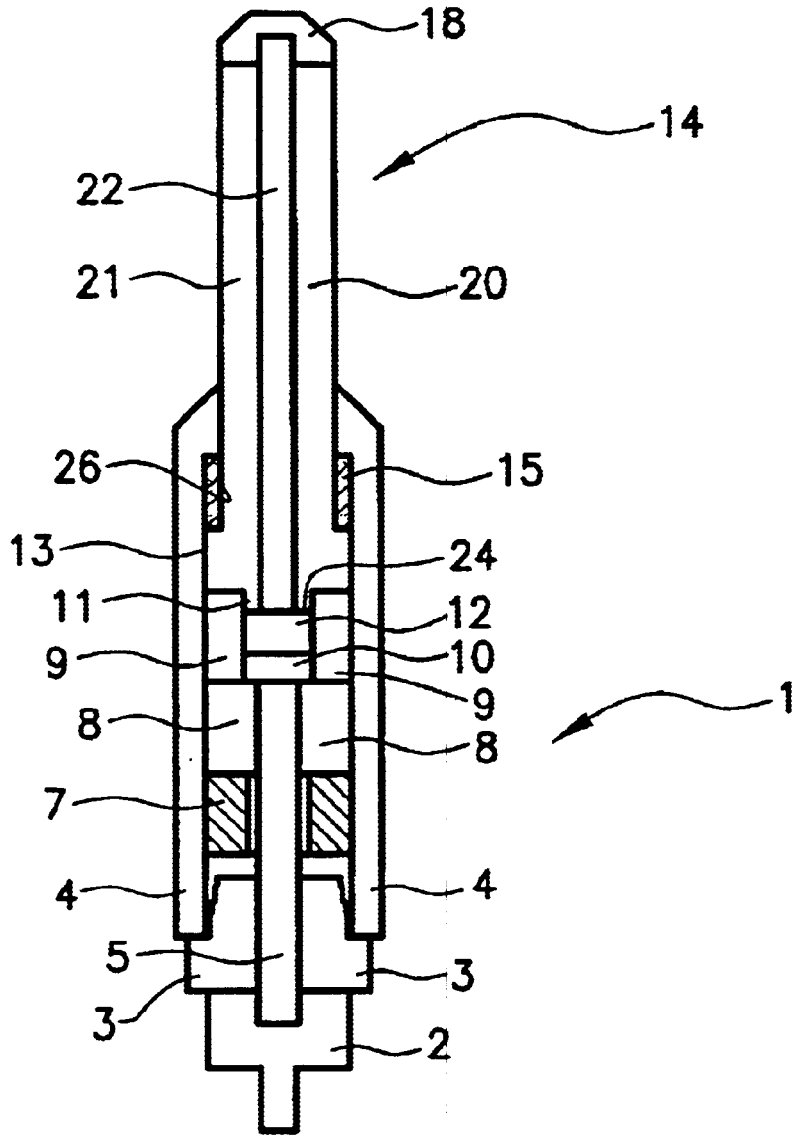
FIG. 5 shows a longitudinal section of the exemplary sheathed-element glow plug according to the present invention.

FIG. 5 shows another exemplary embodiment of the present invention in the form of a schematic longitudinal section through a sheathed-element glow plug 1 according to the present invention. The same symbols used in the previous Figures denote the same components, which are not explained here again. As in FIG. 1, the sheathed-element glow plug illustrated in FIG. 5 has a round plug 2, which is in electrical contact with cylindrical supply conductor 5. Cylindrical supply conductor 5 is electrically connected to ceramic glow element 14 via contact pin 10 and contacting element 12. Cylindrical supply conductor 5, contact pin 10, contacting element 12, and ceramic glow element 14 are arranged in sequence, in this order, as shown in FIG. 5, in the direction of the combustion chamber. In the exemplary embodiment illustrated in FIG. 5, the end of ceramic glow element 14 farther removed from the combustion chamber has a journal 11. Journal 11 forms an extension of glow element 14 in the direction of the end farther removed from the combustion chamber through a cylindrical lead-through of ceramic supply layers 20, 21 and insulation layer 22, journal 11 having a smaller outer diameter than shoulder 13, the part of glow element 14 which follows in the direction of the combustion chamber. Furthermore, it is not necessary that the combustion chamber end of glow element 14 have a heating layer 18. In an exemplary embodiment, both supply layers 20 and 21 may be connected only on the combustion chamber side of the glow element as they are via heating element 18.

Cylindrical supply conductor 5 and contact pin 10 together form the connecting element, which can also be designed in one piece. A flange which, together with journal 11, delimits contacting element 12 in the direction of the axis of the sheathed-element glow plug is provided on the end of the connecting element on the combustion chamber side.

Contacting element 12, which is composed of a pellet made of an electrically conductive powder, may be made of graphite or metal powder or an electrically conductive ceramic powder. In another exemplary embodiment, the pellet may be made of an electrically conductive powder predominantly made of graphite or metal powder or of the electrically conductive ceramic powder. Due to the design of contacting element 12 as an electrically conductive powder, contacting element 12 guarantees elastic contact capable of carrying high currents without heat damage. The large surface area of the powder ensures good heat conductivity. For the same reason, a low contact resistance can also be achieved together with good conductivity. Graphite and ceramic conductive materials are also corrosion-resistant. It is believed that the elastic spring component of the pellet made of an electrically conductive powder ensures that the pellet compensates for thermal displacements of the components due to different heat expansion coefficients.

Laterally, the pellet made of an electrically conductive powder is delimited by a cylindrical adapter sleeve 9, which is present here as a standalone component instead of the ceramic sleeve 8 shown in FIG. 1. Adapter sleeve 9 is provided, like ceramic sleeve 8, as an insulating component; in an exemplary embodiment, it is made of a ceramic material. During the manufacture of the sheathed-element glow plug, the pellet made of electrically conductive powder is pressed in securely between the flange of the connecting element on the end face farther removed from the combustion chamber, journal 11 of glow element 14 on the combustion chamber side end face, and adapter sleeve 9. Being pressed in between these fixed components, in particular between the stationary stop of adapter sleeve 9 on ceramic sleeve 8, i.e., the limited pressing height, prevents the surrounding adapter sleeve 9 from cracking due to an excessive internal pressure buildup due to the pressure exerted on contacting element 12. Axial pre-stressing of the elastic spring component by pressing in the pellet made of electrically conductive powder, can compensate thermal elongations, settling, and vibration stresses in the event of vibrating forces acting on the sheathed-element glow plug.

A sheathed-element glow plug according to FIG. 5 having a pellet made of an electrical conductive powder as contacting element 12 is manufactured as follows. Initially sealing gasket 15 is moved from the combustion chamber-side tip of ceramic glow element 14 over ceramic glow element 14 and introduced as a composite into glow element housing 4 from the end farther removed from the combustion chamber. Subsequently contacting element 12, adapter sleeve 9, connecting element 5, 10, ceramic sleeve 8, and metal ring 7 are arranged in a holding element and then also introduced from the end farther removed from the combustion chamber into glow element housing 4. Subsequently, the components in the glow element housing are pressed together using an axial force exerted on the end farther removed from the combustion chamber of metal ring 7; in particular, contacting element 12, composed of a pellet made of an electrically conductive powder and sealing gasket 15, are pressed. A force is exerted on contacting element 12 only until contact pin 10 of connecting element 5, 10 is completely pressed into adapter sleeve 9 and the end face of ceramic sleeve 8 is in contact with the face of adapter sleeve 9. Pressing the pellet made of an electrically conductive material also ensures that the elastic spring component of the pellet is pre-stressed. Subsequently metal ring 7 is locked using a force applied radially from the outside on glow element housing 4. Seal 3 and round plug 2 are then installed and also locked using a force applied radially from the outside on glow element housing 4.

What is claimed is:

1. A method for making a sheathed-element glow plug including a ceramic glow element, a contacting element, the contacting element including a pellet made of an electrically conductive powder, and a connecting element for supplying power and being electrically connected to the ceramic glow element via the contacting element, the method comprising the steps of:

introducing a sealing gasket from a side tip of a combustion chamber of the ceramic glow element over the ceramic glow element and forming a composite;

introducing the composite into a glow element housing;

arranging components in a holding element, the components including an adapter sleeve, the connecting element, a ceramic sleeve, a metal ring and the pellet made of an electrically conductive powder;

introducing the holding element into the glow element housing;

pressing the components in the glow element housing using an axial force that is exerted on an end of the metal ring farther removed from the combustion chamber; and locking the metal ring using a force applied radially to the glow element housing from outside of it.

2. The method of claim 1, further comprising the step of applying an axial pre-stress to an elastic spring component of the pellet by pressing the components in the glow element housing using an axial force.

3. The method of claim 2, wherein the electrically conductive powder is predominantly made of at least one of a graphite, a metal powder and an electrically conductive ceramic powder.

4. The method of claim 2, wherein the electrically conductive powder is predominantly made of a graphite.

5. The method of claim 2, wherein the electrically conductive powder is predominantly made of a metal powder.

6. The method of claim 2, wherein the electrically conductive powder is predominantly made of an electrically conductive ceramic powder.

7. The method of claim 1, wherein the electrically conductive powder is predominantly made of at least one of a graphite, a metal powder and an electrically conductive ceramic powder.

8. The method of claim 1, wherein the electrically conductive powder is predominantly made of a graphite.

9. The method of claim 1, wherein the electrically conductive powder is predominantly made of a metal powder.

10. The method of claim 1, wherein the electrically conductive powder is predominantly made of an electrically conductive ceramic powder.

* * * * *